US009440838B1

(12) United States Patent
Paige

(10) Patent No.: US 9,440,838 B1
(45) Date of Patent: Sep. 13, 2016

(54) INTERACTIVE LIQUID DRIP CATCHER FOR BAG-IN-THE-BOX LIQUID CONTAINERS

(71) Applicant: Lawrence Michael Paige, Thousand Oaks, CA (US)

(72) Inventor: Lawrence Michael Paige, Thousand Oaks, CA (US)

( * ) Notice: Subject to any disclaimer, the term of this patent is extended or adjusted under 35 U.S.C. 154(b) by 0 days.

(21) Appl. No.: 14/804,325

(22) Filed: Jul. 20, 2015

(51) Int. Cl.
*B67D 1/16* (2006.01)
*B67D 3/00* (2006.01)

(52) U.S. Cl.
CPC ..... *B67D 1/16* (2013.01); *B67D 3/0067* (2013.01)

(58) Field of Classification Search
CPC .... B67D 1/16; B67D 3/0067; B67D 3/0058; B65D 23/06; B65D 23/065; B65D 47/40
USPC ..... 222/108; 137/312; 220/571
See application file for complete search history.

(56) References Cited

U.S. PATENT DOCUMENTS 702,181 A * 6/1902 Boyd ..... B67D 1/16 137/313
1,520,511 A * 12/1924 Reymore ..... B67D 1/16 137/313
1,703,284 A * 2/1929 Wolfe ..... B67D 1/16 137/312
1,714,281 A * 5/1929 Spring ..... A47K 5/10 222/108
2,834,516 A * 5/1958 Mosher ..... B67D 1/16 222/108
5,470,011 A * 11/1995 Jordan ..... B67D 1/16 222/108
5,690,138 A * 11/1997 Fuller ..... B67D 1/16 137/312
6,279,781 B1 * 8/2001 Konar ..... B67D 1/16 137/312
7,992,586 B1 * 8/2011 Bovee ..... B67D 1/1256 137/312
8,320,752 B1 * 11/2012 Bergau ..... A47J 31/46 222/108
2006/0113321 A1 * 6/2006 Kaeb ..... B67D 1/16 222/110
2008/0314924 A1 * 12/2008 Marr ..... B65D 23/065 222/108
2009/0236364 A1 * 9/2009 Njaastad ..... B67D 1/16 222/108
2010/0065583 A1 * 3/2010 Leggett ..... B67D 1/16 222/108

* cited by examiner

*Primary Examiner* — Patrick M Buechner
*Assistant Examiner* — Benjamin R Shaw

(57) ABSTRACT

An interactive device for catching drips from a spout commonly associated with bag-in-the-box liquid containers. The apparatus attaches to features of the spout and a pendulum element blocks access to the liquid flow path beneath the spout. A cup makes contact with the pendulum, forcing it aside to gain access to the liquid flow path. The pendulum returns beneath the spout, via gravity, when interaction is complete.

5 Claims, 4 Drawing Sheets

INTERACTIVE LIQUID DRIP CATCHER FOR BAG-IN-THE-BOX LIQUID CONTAINERS

CROSS-REFERENCE TO RELATED APPLICATIONS

This application claims the benefit of provisional patent application No. 62/032,563 filed on Aug. 2, 2014

BACKGROUND

Prior Art

As bag-in-the-box liquid containers have grown popular with consumers, the issues with a leaking spout associated with these containers have grown more common. Drips appear from these types of spouts due to the retained liquid that did not make the full transition from the container to the users cup, after the spout valve is closed. This dilemma allowed opportunity for unique solutions to arise and become tangible. However, most were rejected due to their size, portability and effectiveness.

Designs for catching drips from bag-in-a-box spouts have great merit but lack certain valuable aspects. U.S. Pat. No. 6,279,781 to Konar (2001) claims that the "Box Liquid Drip Cather" can be rotated 180 degrees about a spout, of which it is attached, with no reference to a hard stop or how it is supported rotationally about the spout, as if gravity is not an issue. This product is not effective while in the refrigerator with the apparatus upside down (180), and cannot be used as intended sans a nearby ledge. The device requires a platform, near to a ledge, to allow for the unit to overhang below said platform to be effective. Also the unit attaches to a spout without indication of where the user is to locate the unit fore and aft along the axis of said spout. A test run is required to discover if the unit is positioned correctly under the drip.

U.S. Pat. No. 8,172,111 to Fowler et al (2008) explains how the device needs to be within close proximity to the edge of a table or surface-edge to be effective. Fowler's device utilizes a hinge that connects to a mating piece of the invention, but is not attached to the tap or container that is leaking. The hinge element is used to empty the device, but is not an element during the operation of dispensing liquid. Furthermore, as the liquid in the container is consumed; eventually the container is no longer heavy enough to securely keep this device in its intended operating position. For example: There is no longer a weight holding the device down to the surface that is supporting it.

My drip catcher remains on duty, under the tap at all times except when it is rotated beyond 180 degrees to a hard stop location, then allowing the user to fill a large container, e.g. wine glass or carafe. My drip catcher works while the container is resting on any surface because it does not require a ledge, edge or table surface with a ledge. There is no need to empty it, as it uses absorption pads that retain the liquid.

My hinged operation is utilized every time liquid is dispensed from the tap. The attachment method positions my drip catcher correctly under the spout every time by utilizing locating flanges that are an existing feature of bag-in-the-box packaging and manufacturing. My device does not have a closed keyhole design that allows a pass through of a spout then requiring another profile to mount it to the spout. It mounts directly from above the spout and attaches to the spout flanges that make contact with three saddle-locating surfaces of my drip catcher. Nothing rotates about the spout, but about the feature that is gripping the spout. My drip catcher expands and contracts when mounted; not the spout. It does not rotate freely about the spout, but about the pivot point contained in my drip catcher.

Although most solutions work, none are small enough to be considered handy. Prior art includes devices that hang from a tap or spout, but do not have a feature that attaches to the spout and have mechanical motion during operation. Others take the approach of hanging their device at the edge of a platform or a required ledge. My invention does not require a ledge. It simply stays attached and functional no matter where the bag-in-the-box container is located.

Advantages

My interactive drip catcher is a small and effective solution that interactively swings away while the wine glass is being filled. When the glass is removed, gravity returns the pendulum of my device directly under the tap. This device can be attached to a bag-in-the-box container and travel along with it. The attachment method locates the device correctly for effective performance every time. The lowest part of the device is higher than the lowest feature of the boxed wine container. This means it can be set on a flat surface such as a refrigerator shelf or countertop while remaining effective and does not need to be positioned near a ledge. My device is effective regardless of what surface the boxed wine is located. My invention does not limit the user to any size of container or wine glass to be filled. My solution employs a pendulum with an absorption pad immediately below the spout to deter the splash affects that occur with other inventions. Also, when the pendulum swings beyond 180 degrees to an integrated hard stop; the absorption pad will not leak.

SUMMARY OF THE INVENTION

The present invention is a interactive portable device that collects liquid drops from a spout commonly found on bag-in-the-box liquid containers. The reusable device attaches to features of a spout from the container for its intended use. A pendulum type pendulum swings away with user interaction and returns to plumb via gravity. This device is comprised of three pieces: a saddle, swinging pendulum and an absorption pad. The saddle employs a unique attachment method to a spout commonly used with bag-in-a-box liquid containers. The swinging pendulum is attached to the top of the Saddle at a pivot point and hangs freely below the spout by means of a connecting arm integrated into the design of the swinging pendulum. A cavity in the swinging pendulum houses a felt absorption pad. The pad absorbs and retains the drips.

DRAWINGS

Figures

REFERENCE NUMERALS

10 Saddle
12 Pendulum
14 Absorption Pad
16 Tap/Spout
18 Bag-in-a-Box Container
20 Bag-in-a-Box Byproduct Flanges
22 Pivot Point between Saddle and Pendulum
24 Vertical Alignment Reference
26 Hard Stop
28 Pendulum Bottom
30 Container bottom
32 Pendulum Arm
34 Saddle Retainers
36 Saddle Expansion
38 Saddle Retraction
40 Saddle Locating Surfaces 3×
41 Wine Glass

DETAILED DESCRIPTION

Figure 1:
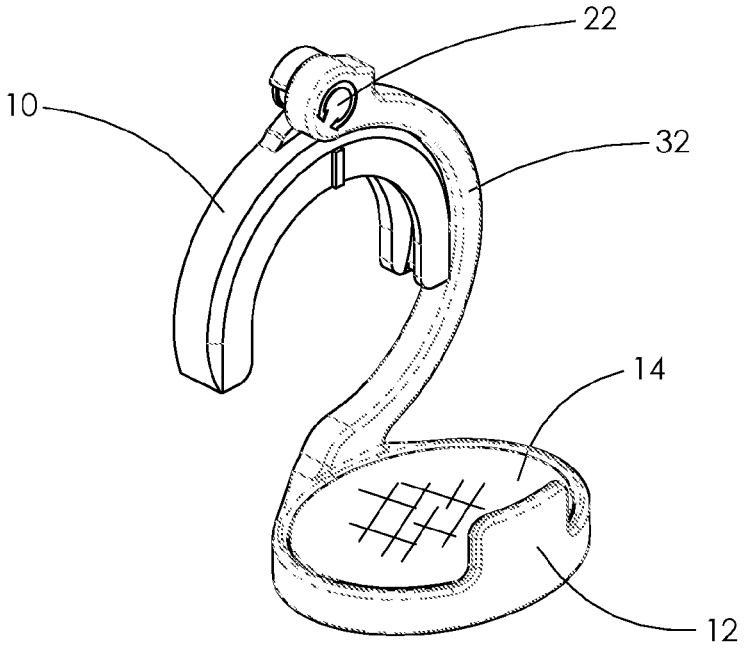
FIG. 1 Shows the main components of the interactive drip catcher.

A preferred embodiment of the interactive drip catcher is illustrated in FIG. 1. The saddle 10 has a expandable opening. The pendulum 12 attaches remotely to saddle 10 at the pivot point 22 via a Pendulum arm 32. The absorption pad 14 is mounted in a cavity within the Pendulum 12.

Figure 2:
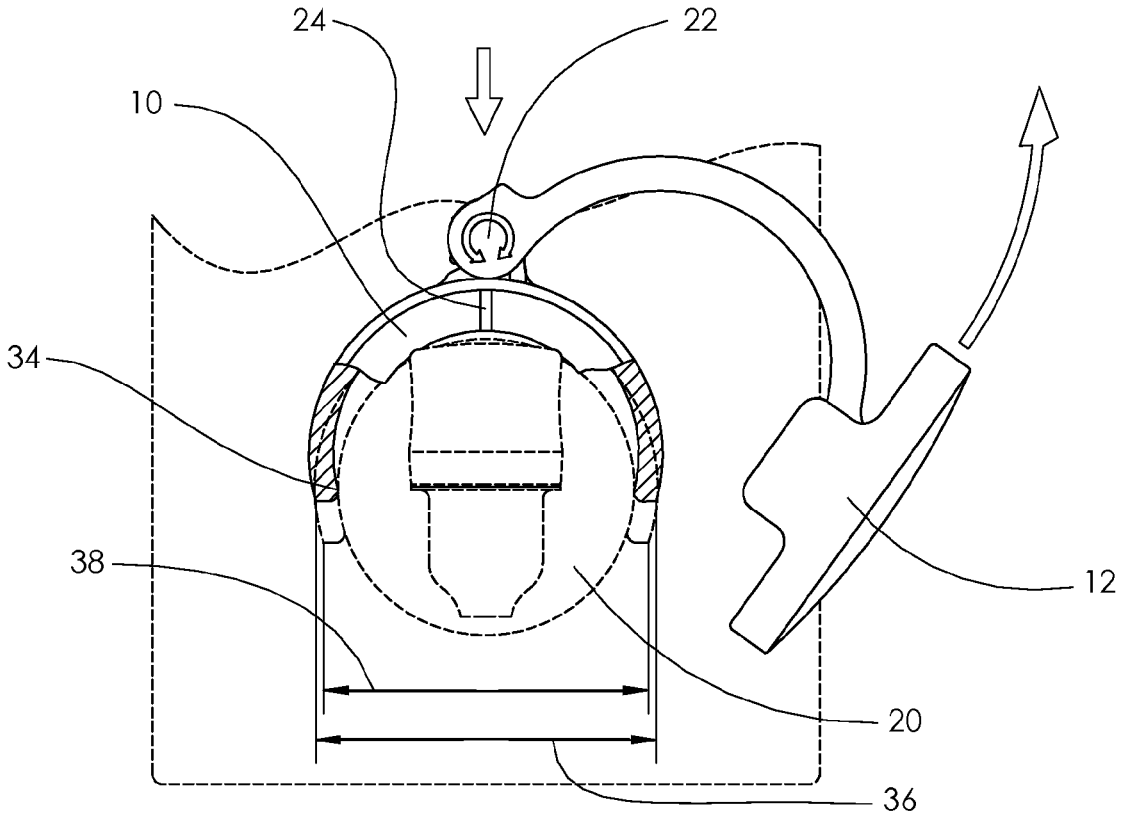
FIG. 2 Shows a method of attaching the saddle

FIG. 2 displays how to mount the device. The pendulum 12 swings away about pivot point 22 while the saddle 10 is lowered over the flanges 20. The saddle 10 expands 36 around flanges 20 until saddle 10 is concentric with flanges 20 and contracted 38. The cause of the saddle 10 retention is the saddle 10 retainers 34. Once mounted, they keep tension beyond the quadrants of the flanges 20 and require expansion 36 to remove. Saddle 10 also incorporates a vertical alignment reference 24 to aid in correct positioning while mounting.

Figure 3:
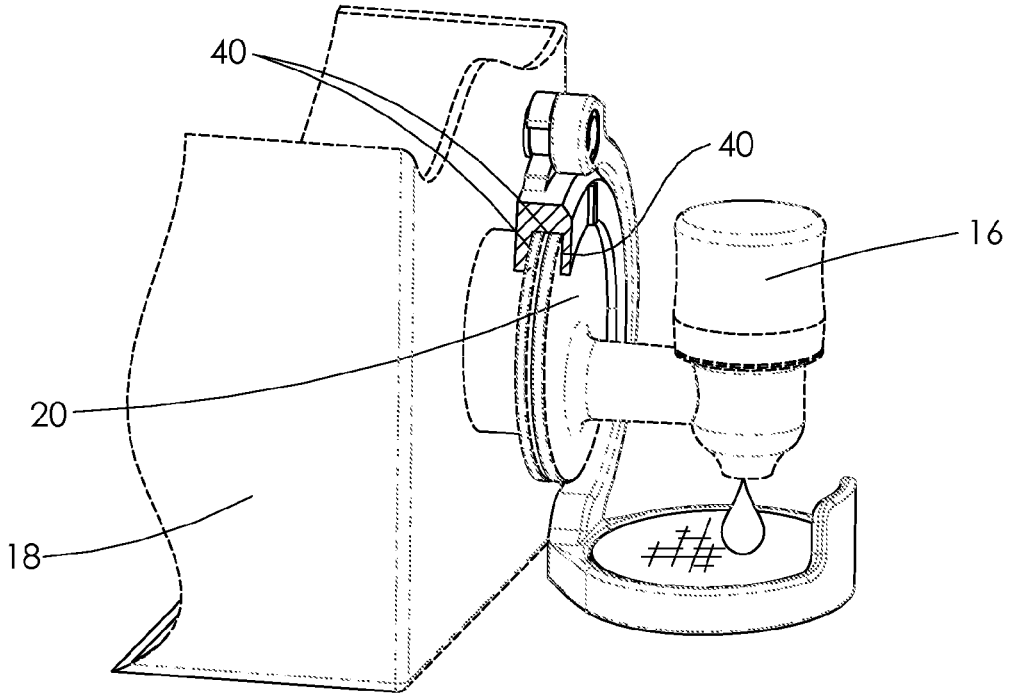
FIG. 3 Shows a saddle interface with spout flanges

FIG. 3 shows three saddle locating surfaces 40 mating with the spout flanges 20. This locating method ensures the Pendulum 12 will be positioned correctly along the axis of the spout 16 and a correct distance away from the bag-in-the-box container 18.

Figure 4:
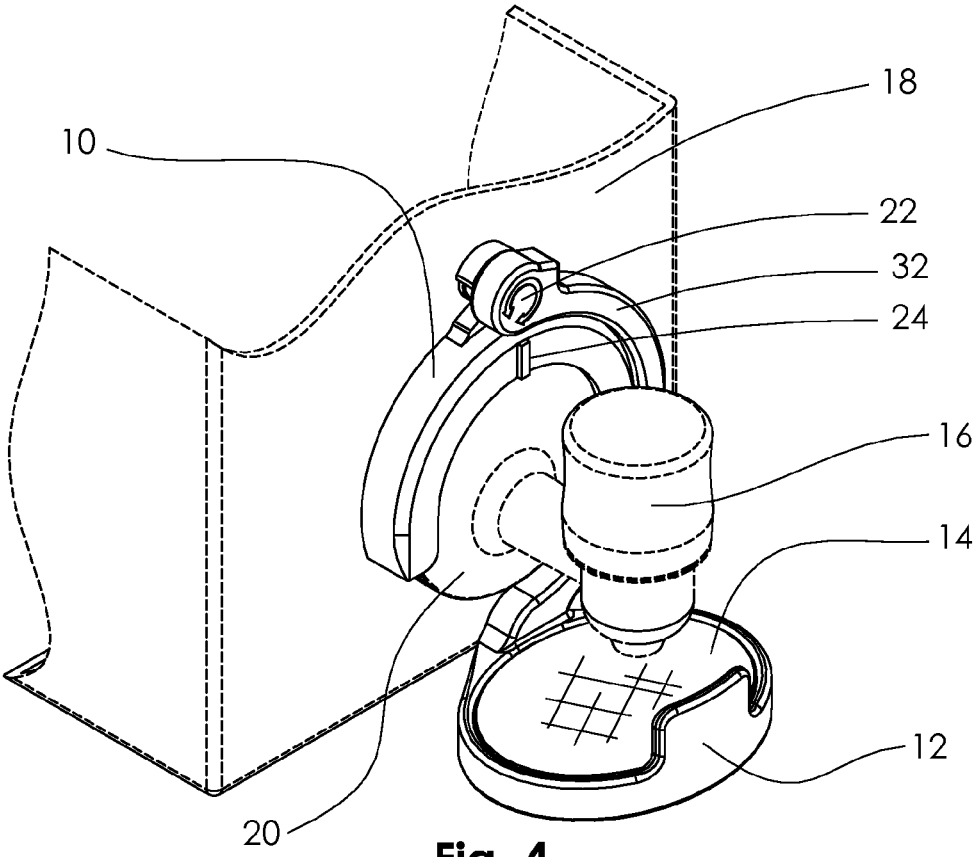
FIG. 4 Shows a interactive drip catcher installed

FIG. 4 shows how the device naturally hangs after mounted correctly via gravity. Here one can see the saddle 10 is mounted and stationary to flanges 20 while pendulum 12 is attached at pivot point 22 via pendulum arm 32 and free to rotate counterclockwise. While not in use; pendulum 12 and absorption pad 14 remain positioned as seen in this view.

Figure 5:
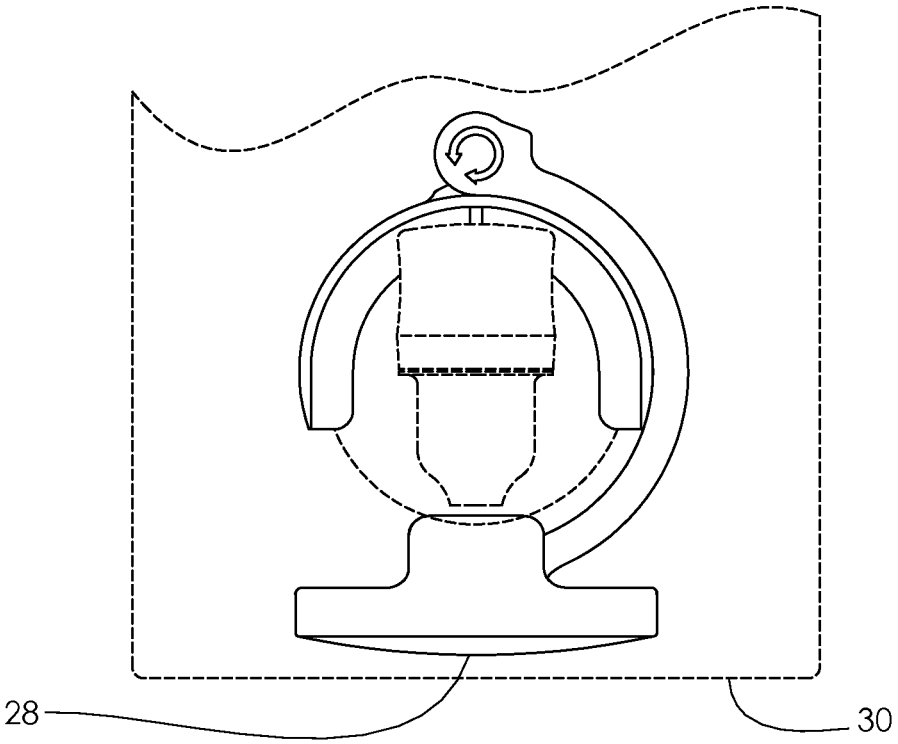
FIG. 5 Shows relationship of container bottom to pendulum bottom

FIG. 5 displays that the pendulum bottom 28 is higher in elevation than the container bottom 30. This allows the device to be used on any surface that the container 18 is resting. No ledge is necessary for the device to keep collecting drips. This also allows for the device to be used in a refrigerator while still serving its intended purpose.

Figure 6:
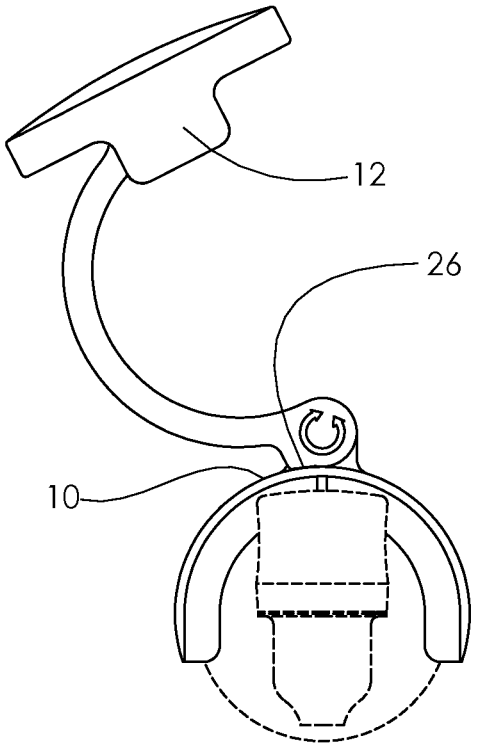
FIG. 6 Shows pendulum beyond 180 degree rotation to a hard stop

FIG. 6 shows the hard stop 26 feature with the pendulum 12 inverted and contacting the saddle 10

OPERATION

Figure 7:
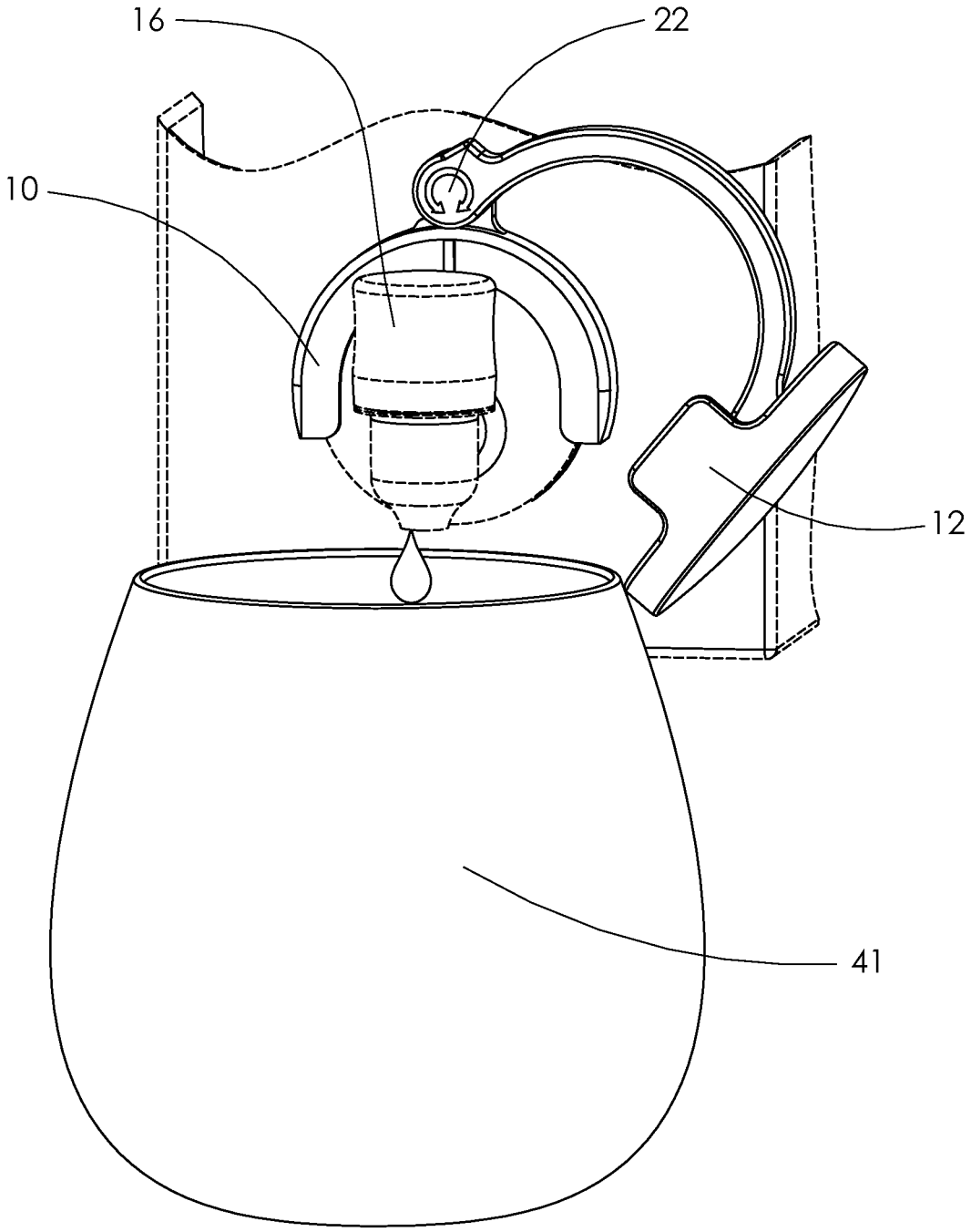
FIG. 7 Shows operation of pendulum and users wine glass

FIG. 7 shows the users wine glass 41 or other container forcing the pendulum 12 counterclockwise about pivot point 22 by overcoming gravity. Saddle 10 remains stationary and the user is now free to open and close the spout 16. When the spout 16 is closed and the users glass 41 removed, the pendulum 12 returns under the spout 16 via gravity.

I claim:

1. A interactive drip catcher for use on spouts associated with bag-in-box liquid containers, said catcher comprising a flexible arc saddle positioned on features of said spout and employing a pivot point located above said saddle where a pendulum containing an absorption pad connects remotely to rotate about said pivot point whereby said pendulum rests under said spout sans user interaction via gravity, wherein said pendulum having a pendulum-arm connected to said pivot point and extending downwardly following a radial profile of said saddle whereby terminating to a oval shallow tub located underneath said spout.

2. The catcher in claim 1 wherein said pendulum comprises a oval shallow tub with a cavity to receive said absorption pad.

3. The catcher of claim 1 wherein said saddle has a cross section of an inverted u-shape as a means to mount and locate to features of said spout.

4. The catcher of claim 1 wherein said pendulum and said saddle are comprised of plastic material.

5. The catcher of claim 1 wherein said absorption pad is comprised of a felt material.

* * * * *